United States Patent [19]

Hailey

[11] Patent Number: 4,518,441

[45] Date of Patent: May 21, 1985

[54] METHOD OF PRODUCING METAL ALLOYS WITH HIGH MODULUS OF ELASTICITY

[76] Inventor: Robert W. Hailey, 2030-229 Beverly Plz., Long Beach, Calif. 90815

[21] Appl. No.: 585,400

[22] Filed: Mar. 2, 1984

[51] Int. Cl.[3] ..... B22F 3/14

[52] U.S. Cl. ..... 148/11.5 P; 419/48; 419/49; 419/51

[58] Field of Search ..... 148/11.5 P; 419/48, 419/51, 49; 425/78

[56] References Cited

U.S. PATENT DOCUMENTS 3,356,496 12/1967 Hailey ..... 75/226

3,689,259 9/1972 Hailey ..... 75/226

*Primary Examiner*—W. Stallard

*Attorney, Agent, or Firm*—William W. Haefliger

[57] ABSTRACT

A method for producing metal alloys with improved properties such as a high modulus of elasticity, includes:

(a) mixing fine metal powders and blending and milling said mix to a homogeneous condition, (b) forming the mix to a preliminary powder shape, said forming including exerting pressure on the mix, (c) and heating and transferring said powder shape to a hot refractory particle matrix and pressurizing said matrix so as to consolidate and densify the powder shape and to diffusion bond the powders into a solid body, (d) whereby the body may be subjected to a subsequent heat treatment serving to develop the uniformity, the grain structure, and the properties required in the alloy body.

9 Claims, 2 Drawing Figures

METHOD OF PRODUCING METAL ALLOYS WITH HIGH MODULUS OF ELASTICITY

BACKGROUND OF THE INVENTION

This invention relates generally to the consolidation of powdered materials to form dense parts, of shaped form, and more specifically concerns improved methods and steps facilitating such consolidation and improved properties of the resultant shapes.

In structural and other industries, there is a continuing strong need for materials with improved properties such as an increased modulus of elasticity (stiffness), to allow more efficient and safer design and use. Such materials must be available in a range of needed forms and sizes.

Structural or high performance alloys are characteristically limited to a standard relatively lower level modulus of elasticity because they are made by initial melting and casting methods that produce this lower level as a constant. In addition to a lower level of modulus of elasticity in cast or cast and worked alloys, it is difficult to control the chemical and metallurgical uniformity and quality of these alloys because of segregation and grain growth phenomena that occur during solidification. Elements or compounds may be added to a melt for the purpose of improving chemical and metallurgical uniformity, but usually will have limited effectiveness and can act as impurities that in the final product are detrimental to the obtaining of optimum mechanical and physical properties. Standard powder metallurgy methods have not provided desired forms and combinations of powders, or methods for blending powders and consolidating them to full density and full properties, with most standard powder metallurgy products having relatively low level (i.e. less than desired) overall properties.

SUMMARY OF THE INVENTION

It is a major object of the invention to overcome the problems and deficiencies referred to above. In this regard, the invention provides a method for making full density alloy products from metal powders, with certain alloy properties (such as the modulus of elasticity) greatly increased over standard alloys. Chemical uniformity is achieved by using very fine powders which are thoroughly blended and are resistant to segregation in later processing. A controlled high level of purity in a final product results through the use of special means to maintain powder purity through process steps that include preparation, blending, preforming and high temperature consolidation. Uniform fine grain size is produced in the final product because the fine powders used are consolidated at temperatures below the melting point of the major alloy constituents of the product, and because both temperature, and time at temperature, can be limited and controlled to control grain size.

Basically, the method for producing metal alloys with improved properties, such as high moduli of elasticity, includes the following steps:

(a) mixing fine metal powders of a desired alloy composition with a relatively small weight percentage of fine, non-metal powder, and blending said mix to a homogeneous condition, (b) forming the mix to a preliminary powder shape, said forming including exerting pressure on the mix, or sintering the mix as a shaped form.

(c) and transferring pressure to said powder shape via a hot ceramic particle matrix so as to consolidate and densify the powder shape and to diffusion bond the powders into a solid body, (d) whereby the body may be subjected to a subsequent heat treatment serving to develop the uniformity, the grain structure, and the properties required in the alloy body.

Typically, the consolidation step is carried out in a controlled inert or reducing atmosphere; the major alloy constituent by weight in the mix is selected from the group that includes iron, cobalt and nickel, and the non-metallic powder ingredient is selected from the group that includes carbon, boron and silicon. In addition, the powders in the mixture are typically ball milled together to enhance the breakdown, distribution and alloying characteristics of the powders as well as their handling and pressing characteristics.

Unusual advantages of the invention includes the following:

(a) close to an optimum dispersion of strengthening elements or compounds in a final alloy is achieved;

(b) the invention enables the use of minimum amounts of alloy additions in an alloy to achieve desired properties, because alloying elements or compounds are distributed and utilized with maximum effectiveness and control for predictable results;

(c) the invention allows the use of alloying additions in types and amounts not possible with castings because processing methods prevent segregation and undesirable concentrations of alloying elements that are difficult to control in castings; and (c) the invention affords a predictable means for obtaining increased moduli of elasticity and other improved properties in a range of sizes and shapes of product not previously possible.

These and other objects and advantages of the invention, as well as the details of an illustrative embodiment, will be more fully understood from the following description and drawings, in which:

DRAWING DESCRIPTION

DETAILED DESCRIPTION

Figure 1:
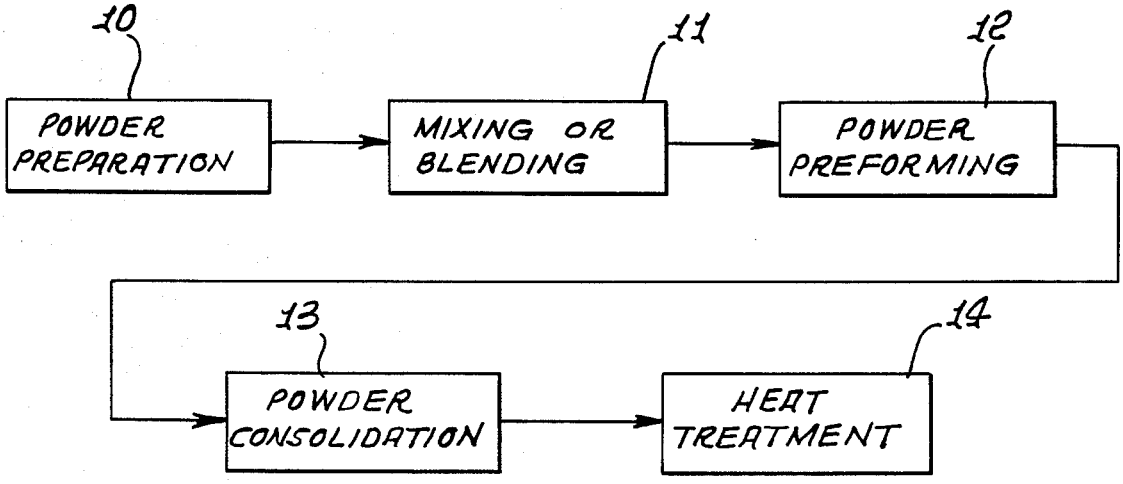
FIG. 1 is a flow diagram.

The basic steps required for making high modulus alloys with metal powders are shown in FIG. 1, and include:

a. Powder preparation
b. Powder mixing and/or blending
c. Powder preforming
d. Powder consolidation
e. Heat treatment.

The initial step, powder preparation shown at 10 in FIG. 1, involves selecting major alloying constituent and minor alloying constituent metal powders as required for product properties, with high purity, and with such powders being very fine, i.e. less than 30 microns average diameter and preferably in the order of 10 microns or less diameter. Major alloying constituent metals (as grouped in the periodic table) include iron, cobalt and nickel. Minor (by weight) alloying constituent metals may include the ferrous and nonferrous and refractory metals in the metals and transition metal groups of the periodic table, eg the following metals: titanium, vanadium, chromium, manganese, scandium, yttrium, zirconium, niobium, molybdenum, hafnium, tantalum, tungsten, rhenium, iron, cobalt, nickel, copper, aluminum, zinc, gallium, germanium, cadmium, indium, tin, antimony, thallium, lead, lithium, beryllium, sodium, magnesium, potassium, calcium, rubidium, strontium, cesium, barium, but may also include nonmetals such as carbon, boron, silicon and others, and compounds such as carbides and/or oxides of the above metals.

Carbon powder, with average particle diameters preferably less than 5 microns, is employed as a primary minor alloying addition, especially where the ferrous group of metals are major constituents. The powders are stored in a dry, inert atmosphere to prevent oxidation and hydration.

Powder mixing and/or blending is indicated at 11 in FIG. 1, and involves preliminary mixing of major and minor alloying constituent powders by standard means such as a V-blender, for a relatiavely short time compared to final blending time. Representative times are 10 to 30 minutes.

Final blending is carried out with a ball mill, typically of standard cylindrical configuration. The mill is designed for use with an inert or non-active atmosphere as for example $N_2$ or Argon, to maintain powder purity and assure consistent powder flow and blending. The ball sizes and shapes, mill size, powder charge and milling time are established to give a steady tumbling action of powder and balls so that all parts of the powder charge are uniformly milled and blended to a homogeneous mix. The ball milling may provide some cold bonding of the alloying constituents through ball impact, which can act to increase the stability of the powder blend during handling, and increase alloying rates during consolidation and following heat treatment.

Representative mixes are as follows, the ingredients being in powder form:

| Ingredient | approximate weight percent |
|---|---|
| Example I | |
| Iron | 99.6% |
| Carbon | .4% |
| Example II | |
| Cobalt | 64.25% |
| Chromium | 30.0% |
| Tungsten | 4.5% |
| Carbon | 1.25% |

In all cases, the amount of carbon, or boron, or silicon should be between about 0.10 and 3.00 weight percent of the mix.

Powder mix preforming is indicated at 12 in FIG. 1. It is accomplished by one of the following:

a. Packing the blended powders to a stable density and to a shape as required for consolidation, in a ceramic or other mold form suitable for processing through the consolidation step that follows; or b. Cold pressing the blended powders to preform shape of the configuration required for consolidating to final form; or c. Packing the blended powders to shape as required for consolidation in a mold form which can be removed, and lightly sintering the powder to a weakly bonded by coherent shape in a controlled atmosphere before removing the mold form. Typical sintering temperatures are 500° F. to 2500° F.; and the controlled atmosphere typically consists of A, $N_2$, $H_2$, or mixes thereof.

Consolidation of the pre-form is accomplished by methods disclosed in U.S. Pat. Nos. 3,356,496 and/or 3,689,259 to Hailey, and employing:

a. Pressures and temperatures that will consolidate the alloy product close to full density. Typical pressures are 20 to 40 tsi; and typical temperatures are 1000° F. to 2,600° F., applied for a consolidation time of 1–10 seconds.

b. Inert or reducing atmospheres as required for the alloying constituents. Typical of such gases are $N_2$, A, $H_2$, and mixes of $N_2$ and $H_2$ and of A and $H_2$.

c. Time at temperature for heating the part as required for achieving desired properties in the final alloy. Typical times are 5 to 60 minutes.

Figure 2:
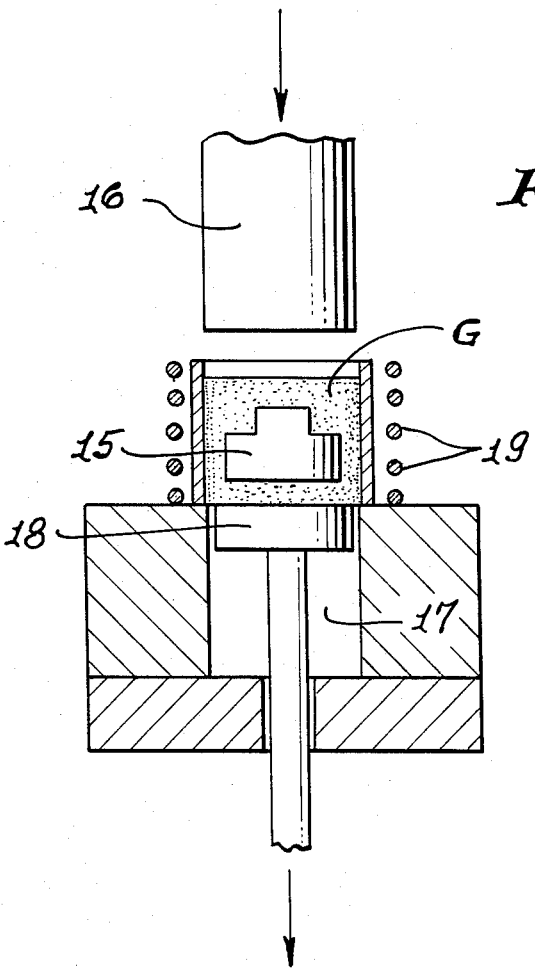
FIG. 2 illustrates the consolidation step.

FIG. 2 shows the preform 15 embedded in ceramic grain or particle bed G. Descent of the punch 16 displaces the grain pack G and part 15 downwardly into cavity 17; and the die plunger 18 is also displaced downwardly. Consolidation occurs in cavity 17, with pressure application transferred from punch 16 to the grain pack in the cavity, and thence to the pre-form. The pre-form is induction heated by heater elements 19 prior to its descent into the cavity 17. Other heating means may be used.

Heat treatment after consolidation is indicated at 14 in FIG. 1. It is used for the purpose of providing for diffusion of alloying elements to give a uniform composition and grain structure. Another purpose is to develop the properties required in the product by an annealing or precipitation hardening heat treatment after the diffusion heat treatment.

As a result of the inclusion of finely dispersed carbon in the powder mix, the resultant metal product is characterized by an increase in stiffness (modulus of elasticity) of between 25% and 85% as compared with prior powder metal processes.

I claim:

1. A method for producing metal alloys with improved properties such a substantially increased moduli of elasticity, that includes (a) mixing fine metal and non-metal powders to provide an alloy mix, with the major alloying constituent by weight selected from the group that consists essentially of iron, cobalt and nickel, and with the non-metal minor alloying constituent selected from the group that consists essentially of carbon, boron and silicon, (b) milling said mix in a controlled atmosphere to a homogeneous condition that provides the desired breakdown, distribution and alloying characteristics of the powders, as well as desired handling and pressing characteristics, (c) forming the mix to a preliminary powder shape, said forming including exerting pressure on the mix, (d) and heating and transferring said powder shape to a hot refractory particle matrix and pressurizing said matrix so as to consolidate and densify the powder shape and to diffusion bond the powders to a solid body, (e) whereby the body may be subjected to a subsequent heat treatment serving to develop the uniformity, the grain structure, and the properties required in the alloy body.

2. The method of claim 1 including adding to the mix minor metal alloy constituents selected from the group that includes titanium, vanadium, chromium, manganese, scandium, yttrium, zirconium, niobium, molybdenum, hafnium, tantalum, tungsten, rhenium, iron, cobalt, nickle, copper, aluminum, zinc, gallium, germanium, cadmium, indium, tin, antimony, thallium, lead, lithium, beryllium, sodium, magnesium, potassium, calcium, rubidium, strontium, cesium, and barium.

3. The method of claim 2 wherein said non-metal powder is added to the mix, in an amount between 0.10 and 3.00 weight percent of the mix.

4. The method of claim 3 wherein the mix powder includes constituents selected from the group that includes metal carbides, and oxides of the metals in the group recited in claim 3.

5. The method of claim 1 wherein said (d) step is carried out in a controlled inert or reducing atmosphere.

6. The method of claim 1 wherein said (a) step is carried out in a controlled inert or reducing atmosphere.

7. The method of claim 1 wherein said (c) step is carried out in a controlled inert or reducing atmosphere.

8. The method of claim 1 wherein said (d) step is carried out in a die containing said powder shape and matrix, the powder shape being enclosed by the matrix.

9. The method of claim 1 wherein the powders, when formed in the sub-paragraph (c) step, have particle cross dimensions less than about 30 microns.

* * * * *